US011365114B2

(12) United States Patent
Lee

(10) Patent No.: US 11,365,114 B2
(45) Date of Patent: Jun. 21, 2022

(54) STIRRUP WITH OPENING AND CLOSING FUNCTION

(71) Applicant: Keun Hyo Lee, Suwon-si (KR)

(72) Inventor: Keun Hyo Lee, Suwon-si (KR)

(73) Assignee: Philippe Maloigne, Sauqueuse Saint Lucien (FR)

( * ) Notice: Subject to any disclaimer, the term of this patent is extended or adjusted under 35 U.S.C. 154(b) by 0 days.

(21) Appl. No.: 16/652,170

(22) PCT Filed: Jan. 29, 2018

(86) PCT No.: PCT/KR2018/001229
§ 371 (c)(1),
(2) Date: Jun. 30, 2020

(87) PCT Pub. No.: WO2019/066159
PCT Pub. Date: Apr. 4, 2019

(65) Prior Publication Data

US 2020/0331746 A1 Oct. 22, 2020

(30) Foreign Application Priority Data

Sep. 29, 2017 (KR) ..... 10-2017-0126771

(51) Int. Cl.
*B68C 3/00* (2006.01)

(52) U.S. Cl.
CPC ..... *B68C 3/00* (2013.01); *B68C 2003/0033* (2013.01); *B68C 2003/0058* (2013.01)

(58) Field of Classification Search
CPC ..... B68C 2003/005; B68C 2003/0033; B68C 2003/0058; B68C 3/025
See application file for complete search history.

(56) References Cited

U.S. PATENT DOCUMENTS 259,101 A * 6/1882 Cox ..... B68C 3/0016
1,520,586 A * 12/1922 McCamis ..... B68C 3/02
(Continued)

FOREIGN PATENT DOCUMENTS

AU 8251575 A 1/1977
DE 202007017810 U1 3/2008
(Continued)

OTHER PUBLICATIONS

U.S. Appl. No. 16/257,513, filed Jan. 25, 2019, Philippe Maloigne.
(Continued)

*Primary Examiner* — Joshua J Michener
*Assistant Examiner* — Henry Hooper Mudd
(74) *Attorney, Agent, or Firm* — Harness, Dickey & Pierce PLC

(57) ABSTRACT

The present disclosure relates to a stirrup having an opening and closing function for preventing a body from being injured in a situation such as falling from a horse. The present disclosure provides a stirrup having an opening and closing function, which is coupled to a saddle so that a rider's foot rests thereon, the stirrup including: a main body part having a bottom portion for placing a foot thereon, a top part connected to a saddle strap, and an open part formed on one side thereof; and an opening and closing part for opening and closing the open part, wherein the opening and closing part has one end connected to the main body part with a wire, and the other end which is attachable to and detachable from the main body part by means of magnetic force.

18 Claims, 4 Drawing Sheets

(56) References Cited

U.S. PATENT DOCUMENTS

| | | | | |
|---|---|---|---|---|
| 2005/0120684 | A1 | 6/2005 | Sparacino | |
| 2006/0168919 | A1* | 8/2006 | Strauss | B68C 3/00 54/48 |
| 2016/0194196 | A1 | 7/2016 | Ford | |
| 2017/0275151 | A1* | 9/2017 | Shano | B68C 3/00 |

FOREIGN PATENT DOCUMENTS

| | | | |
|---|---|---|---|
| EP | 3248935 | A1 | 11/2017 |
| KR | 10-2010-0122288 | A | 11/2010 |
| KR | 10-2010-0122289 | A | 11/2010 |
| KR | 10-2013-0092126 | A | 8/2013 |
| WO | WO-2017/182942 | A1 | 10/2017 |

OTHER PUBLICATIONS

English translation of International Search Report dated Jun. 28, 2018 in corresponding Application No. PCT/KR2018/001229.
English translation of Written Opinion dated Jun. 28, 2018 in corresponding Application No. PCT/KR2018/001229.

* cited by examiner

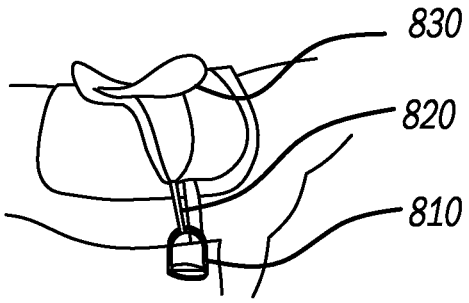
Fig. 1A
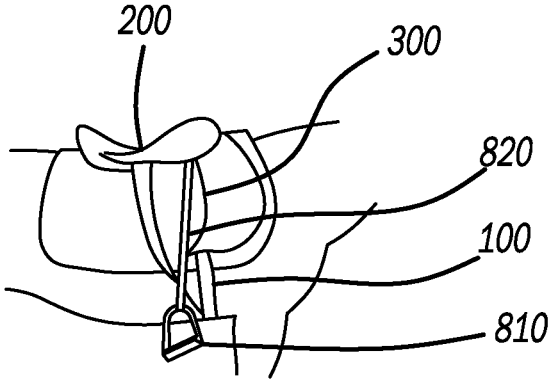
Fig. 1B
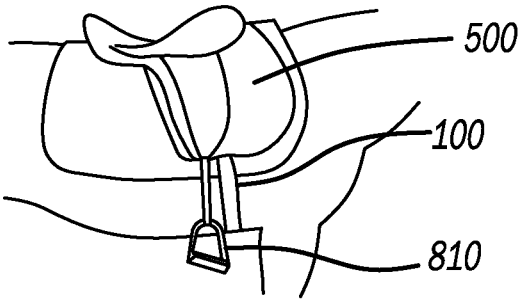
Fig. 1C
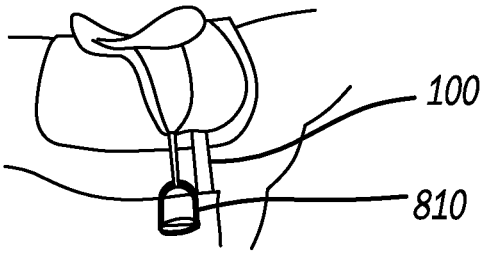
Fig. 1D
Fig. 2
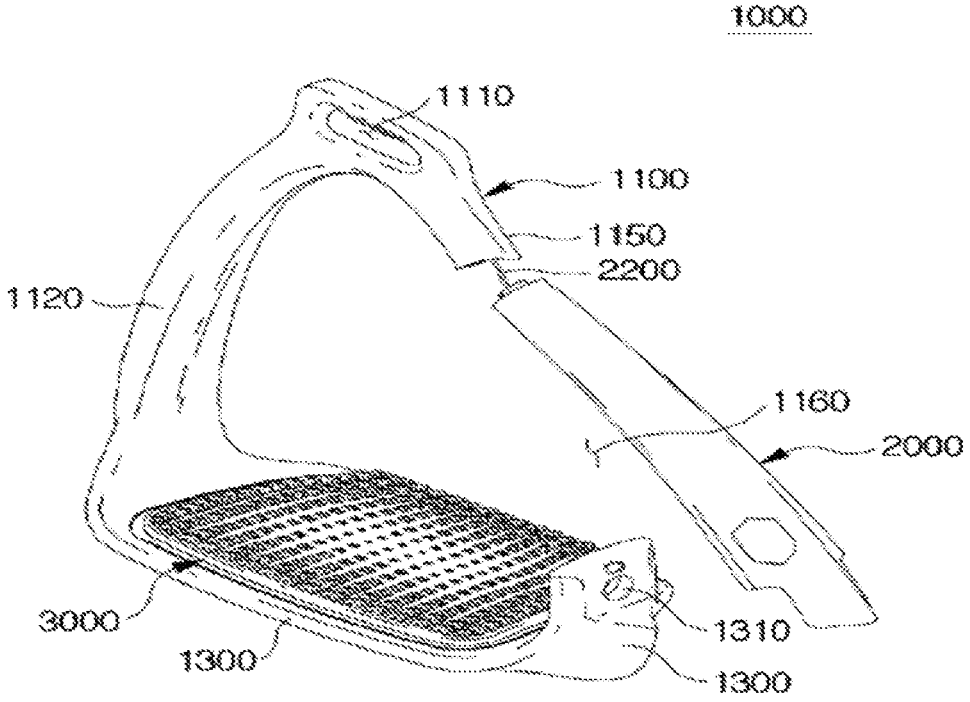

STIRRUP WITH OPENING AND CLOSING FUNCTION

CROSS-REFERENCE TO RELATED APPLICATIONS

This application is a National Phase Entry of International Patent Application No. PCT/KR2018/001229, filed on Jan. 29, 2018, which claims priority to Korean Patent Application No. 1020170126771, filed on Sep. 29, 2017, which are incorporated by reference herein.

TECHNICAL FIELD

The present invention relates to a stirrup, in particular to a stirrup having an opening and closing function for preventing a body from being injured in a situation such as falling from a horse.

BACKGROUND

Generally, a stirrup is hung from a saddle on a horse back to support a foot of a rider who is mounting or riding the horse. For ensuring the rider's safety and learning the correct horse-riding posture, it is deemed very important to accurately place both feet on the stirrups. Placing both feet in the correct positions is generally related to the positions between the rider's heels and the stirrup bottom plates, and relevant trainings need to be received.

Korean Registered Utility Model No. 20-2015-0004667 discloses a conventional stirrup for riding a horse, and FIG. 1 shows a schematic diagram for a relevant use state. Stirrups (810) hung from a saddle (830) are shaped such that a rider may place both feet thereon, and are connected to the saddle (830) in which the rider sits and a stirrup connecting line (820). However, a problem with conventional stirrups is that since stirrups are put around a rider's feet, when the rider tumbles off or falls from the saddle, the feet are still stuck on the stirrup irons, which is dangerous. For example, the rider may be dragged on the ground or hit by a hoof or any other obstacle, suffering a serious injury or death.

Such risk factors cannot be eliminated by adopting any posture along as both feet are placed on the stirrups. Attempts have been made to solve this problem, but no effective technical solution has been developed.

SUMMARY

In order to solve the above-mentioned problem, the present invention is proposed and an objective thereof is to provide a stirrup having an opening and closing function for preventing a rider's foot from being stuck on the stirrup iron in case of a fall from the case, thereby improving the safety of horse riding.

In order to solve the above-mentioned problem, the present invention provides a stirrup having an opening and closing function, which is coupled to a saddle so that a rider's foot rests thereon, the stirrup comprising: a main body part (1100), a hook part (1110) to which a saddle strap may be fastened, a support part (1120) connected to a foot plate base plate (1200), and an open part (1160) formed on one side thereof; an opening and closing part (2000), detachably connected to the open part; and a wire part (2200), connected to one end of the opening and closing part and the main body part. A magnetic body (2010) is disposed on the other end of the opening and closing part, allowing the end to be attachable to the main body part by means of magnetic force. Therefore, when riding a horse, the rider may free his/her feet from the stirrups on either side, thereby improving safety.

Said main body part comprises: an extension part (1150), extending downwards from the upper side of the open part and connected to the wire part; and a coupling part (1300), extending upwards from the lower side of the open part, on which a removable part (1310) is disposed that is combinable with the magnetic body by means of magnetic force. In addition, one end of said wire part is combined with the extension part and the other end thereof is elastically supported by an elasticity-providing part (2150) in a flexible space (2140) formed in the opening and closing part; said elasticity-providing part, when the opening and closing part opens and the foot is completely freed, causes the wire part to shrink, so that the upper end of the opening and closing part is combined with the extension part and the lower end of the opening and closing part comes close to the coupling part, allowing the magnetic body to be detachably coupled to the removable part by means of magnetic force. The upper end of said elasticity-providing part is supportable by an upper inner wall in the flexible space and the lower end thereof is supportable by a fixed part combined with the other end of the wire part.

On the opening and closing part, a projecting part (2120) that projects upwards may preferably be formed and, when the elasticity-providing part causes the wire part to shrink, is guided to be smoothly inserted into an indented part (1151) formed on the extension part. Said coupling part may be configured with a segment gap part (1320) that is layered inwards, corresponding to a contact part of the opening and closing part in which a magnetic body is disposed. In addition, the stirrup may further comprise a foot plate part (3000), which comprises: a foot pad part (3200), combined with the upper side of said foot plate base plate to provide a cushioning effect; and a foot plate upper plate (3100), which is disposed on the upper side of the foot pad part and on which a convex part is further configured.

According to the present invention, in case of a fall from a horse, a force exerted laterally causes the opening and closing part to open freeing the foot naturally, thereby preventing an injury; when the foot has been freed, a closed state is restored by means of restoring force and magnetic force to prevent any secondary damage or injury caused by the movement of the opening and closing part, thereby significantly improving the safety of horse riding.

BRIEF DESCRIPTION OF THE DRAWINGS

FIG. 1 is a schematic diagram for a conventional stirrup for riding a horse;

FIG. 2 is an oblique view of a stirrup having an opening and closing function according to the present invention;

DETAILED DESCRIPTION

Figure 3:
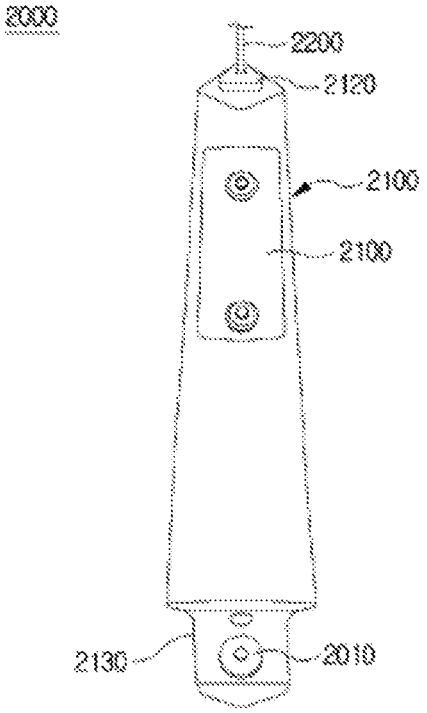
FIG. 3 is a side view of the opening and closing part illustrated from the inner side in the stirrup having an opening and closing function as shown in FIG. 2.

Preferred embodiments of a stirrup having an opening and closing function according to the present invention will be described in detail below with reference to the drawings. In the following description, where it is mentioned that a part is "connected to" another part, it also includes a case in which the parts are connected to each other with another accessory or apparatus between them, in addition to a case in which the parts are directly connected to each other. In addition, where it is mentioned that a structure "comprises" certain structural elements, unless otherwise specified, it means that another structural element may be included, instead of being excluded.

The present invention basically provides a stirrup having an opening and closing function, which is coupled to a saddle so that a rider's foot rests thereon, the stirrup comprising: a main body part having a bottom portion for placing a foot thereon, a top part connected to a saddle strap, and an open part formed on one side thereof; and an opening and closing part for opening and closing the open part, wherein the opening and closing part has one end connected to the main body part with a wire, and the other end which is attachable to and detachable from the main body part by means of magnetic force. A stirrup of the present invention may be installed symmetrically on the left and right sides with a saddle and a saddle strap; for an embodiment of the present invention, an example is given in which a stirrup is installed on the right side, and a repetitive explanation of installation on the other side is omitted herein. In addition, saddles and saddle straps that serve various purposes, are made of various materials, and have various shapes may be used, and these factors do not limit the scope defined by the claims of the present invention.

FIG. 2 is an oblique view of a stirrup having an opening and closing function according to the present invention. The main body part (1100) is roughly ring-like, and an open part (1160) is formed on one side thereof, providing a space for freeing a foot from the stirrup. Said open part (1160) may be opened and closed with the opening and closing part (2000); how the opening and closing part (2000) works to free a foot will be described later. At the upper end of the main body part (1100), a hook part (1110) is disposed for connecting a saddle strap; the embodiment shown in the drawing forms a long-hole shape in a width direction; if it is possible to connect ropes or fixing members of various types and shapes, then its shape is optional.

Said main body part (1100) comprises: a support part (1120), which, on the side facing the open part (1160), is connected downwards from the hook part (1110) to and supports the upper and lower structures; a foot plate base plate (1200), a foot plate part (3000) being disposed on the lower side thereof; and a part forming the upper and lower structures of the open part (1160) and connectable to the opening and closing part (2000). The foot plate part (3000) may be made of a material that is capable of generating friction with a foot and producing a cushioning effect, and is connected to the upper side of the foot plate base plate (1200); a preferred embodiment related to this will be described later.

On the upper and lower sides of the open part (1160), an extension part (1150) and a coupling part (1300) are disposed, which are formed protruding upwards and downwards respectively, and, when combined with the opening and closing part (2000), may form a closed curve pattern with the main body part (1100); note that the arrangement of the extension part (1150) and that of the coupling part (1300) to be described below are mutually interchangeable. Said extension part (1150) extends downwards from the upper side of the main body part (1100) to be connected to the opening and closing part (2000), and is connected to the upper end of the opening and closing part (2000) by a wire part (2200). Said wire part (2200) is capable of generating elastic restoring force or is connected to a component that is capable of generating elastic restoring force, thereby automatically restoring an open state to a closed state; a preferred embodiment related to this will be described later.

Said coupling part (1300) extends from the lower side of the foot plate base plate (1200) provided with the main body part (1100) to the upper side thereof and may be connected to the opening and closing part (2000); such a connection may be broken selectively on the basis of the strength with which a foot is stuck. A conceptual example of the present invention discloses a case in which the coupling part (1300) and the opening and closing part (2000) are connected by means of magnetic force; for this purpose, a magnetic material and/or a magnetic body may be disposed on the other end of the opening and closing part (2000) and in a position on the coupling part (1300) that corresponds to the coupling with the opening and closing part (2000), respectively. Depending on selections, on the removable part (1310) of said coupling part (1300) and the other side of the opening and closing part (2000), magnetic bodies having opposing polarities are disposed facing each other; alternatively, a magnetic body is disposed on one part and a magnetic material is disposed on the other part.

The main body part (1100) and the opening and closing part (2000), as a whole, bear a heavy load; in order to increase their strengths, preferably, a synthetic resin or a metallic material may be used; more preferably, aluminum or an alloy thereof may be used, but the present invention is not limited thereto. However, according to the concept of the present invention, since the opening and closing part (2000) and the coupling part (1300) are detachably connected to each other by means of magnetic force, in order to prevent any possible incorrect coupling between the opening and closing part (2000) and another portion of the main body part (1100), any other portion of the main body part (1100) is most preferably made of a weakly magnetic material. A pole shape is formed upwards and downwards on the opening and closing part (2000), having one end at which a portion is formed for connecting the wire part (2200) and the other end at which a portion is formed that is detachably connected to the removable part (1310) of the coupling part (1300) by means of magnetic force; a specific embodiment related to this will be described below.

FIG. 3 is a side view of the opening and closing part illustrated from the inner side in the stirrup having an opening and closing function as shown in FIG. 2. As described above, the main body part (1100) and the opening and closing part (2000), as a whole, form a ring shape that closes a curve at the front, the opening and closing part (2000) functioning as the open part (1160) of the main body part (1100). Therefore, when the open part (1160) is in a closed state, in order to ensure consistency in the overall shape, the opening and closing part (2000) is the most preferably shaped to be symmetrical with a portion or the whole of the support part (1120).

The main body part (1100) and the opening and closing part (2000), as a whole, form a ring shape and, in order to bear a load, may be shaped to be wide in the lower part and gradually narrow upwards; likewise, the opening and closing part (2000) is also the most preferably shaped to have a lower part that is wide and an upper part that is narrower than the lower part. However, this shape is only an embodiment and is modifiable. The embodiment shown in the drawing illustrates the inner side of the opening and closing part (2000), and the inner side mentioned herein refers to the inner main side of the main body part (1100).

The opening and closing part (2000) may accommodate a structure for connecting to the wire part (2200); in order to prevent contamination from a foreign substance and protect the inner structure, a lid part (2110) capable of covering said accommodation structure may be combined. Said lid part (2110) is installed to cover an opening on the inner side of a shell (2100) that forms the exterior of the opening and closing part (2000).

According to an embodiment of the present invention, as described above, the wire part (2200) connected to the extension part (1150) of the main body part (1100) is connected to the upper end, the lower end may be combined with a magnetic body (2010), and it may then be combined with the removable part (1310) of the coupling part (1300) by means of magnetic force. In the portion where the wire part (2200) is disposed, a projecting part (2120) may be formed, and thus a guiding effect may be produced when the position is restored by means of elasticity. In the portion where the magnetic body (2010) is disposed, a contact part (2130) corresponding to the segment gap of the coupling part (1300) is formed, and thus the structural stability may be improved when they are combined by means of elasticity. The cross-sectional area of a truncated face of the projecting part (2120) and of the contact part (2130) are the most preferably smaller than the cross-sectional area of the shell (2100) adjacent thereto.

Figure 4:
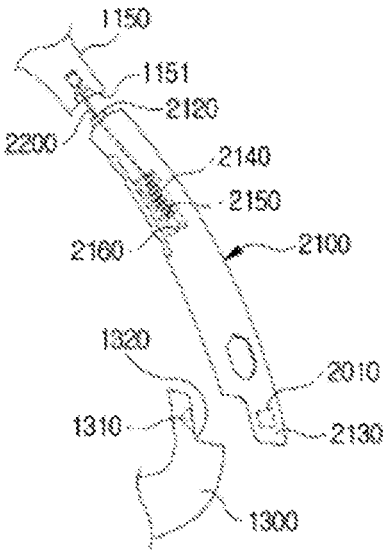
FIG. 4 is a sectional view of an embodiment explaining the opening and closing part of the stirrup.

FIG. 4 is a sectional view of an embodiment explaining the opening and closing part of the stirrup. On the extension part (1150), a portion is formed that is capable of fixing one end of the wire part (2200), and at one end of the opening and closing part (2000) that corresponds thereto, the wire part (2200) is exposed to the outside. One end of said wire part (2200) may be connected to an elasticity-providing part (2150), thus providing an elastic restoring force so that the other end of the opening and closing part (2000) is tightly pressed against the extension part (1150); in the shell (2100), a flexible space (2140), namely, a structure for accommodating a part of the wire part (2200) and the elasticity-providing part (2150), is formed.

The elasticity-providing part (2150) is combined with the interior of the flexible space (2140) to, when observed from the outside relative to the wire part (2200), provide a restoring force in the direction of contraction; the elasticity-providing part (2150) is the most preferably a helical spring. The elasticity-providing part (2150) is disposed surrounding the outer circumference of the other end of the wire part (2200) and the other end is supported by a fixing part (2160) formed at the end. In addition, one end of the elasticity-providing part (2150) may be supported by an inner wall—an inner structure of the flexible space (2140).

When the magnetic body (2010) is detached from the removable part (1310) under the action of a force, and the opening and closing part (2000) is separated from the open part (1160) by a distance, the elasticity-providing part (2150) makes an elongational motion, compresses and further exposes the wire part (2200) to the outside, so that one end of the opening and closing part (2000) moves away from the end of the extension part (1150). The portions in which the wire part (2200) and the magnetic body (2010) are combined are interchangeable; however, in order to allow the magnetic body (2010) and the removable part (1310) to be combined and the opening and closing part (2000) to automatically close the open part (1160) by means of magnetic force, it is best to dispose the wire part (2200) on the upper side of the opening and closing part (2000) and dispose the magnetic body (2010) on the lower side of the opening and closing part (2000), so that they come close to each other under their own weight.

In order to allow the opening and closing part (2000) to close automatically, the elasticity-providing part (2150) causes the wire part (2200) to shrink, so that one end of the opening and closing part (2000) comes into contact with the extension part (1150); in this case, in order to ensure guidance to an accurate position, an indented part (1151) that is tilted from the upper side may be formed on the inner side of the end of the extension part (1150); therefore, the projecting part (2120) is slidable and positioned in the correct slot. In order to ensure smooth guidance during coupling, the width of the indented part (1151) gradually decreases from the end to the interior. Further, when the wire part (2200) elongates, the opening and closing part (2000) is rotatable relative to the main body part (1100); in order to ensure that they have an accurate position and rotational relationship, the indented part (1151) and the projecting part (2120) have asymmetrical shapes at least when observed from one side. Further, the contact part (2130) is formed on the other side of the opening and closing part (2000), so that the magnetic body (2010) and the removable part (1310) are combined by means of magnetic force in accurate positions; on the coupling part (1300), a segment gap part (1320) that is layered inwards and corresponds to the shape of the contact part (2130) may be formed. In addition, segment gaps or recesses are also formed in front and at the back of the coupling part (1300), not only ensuring correct guidance during coupling but also improving structural stability in a closed state.

Figure 5:
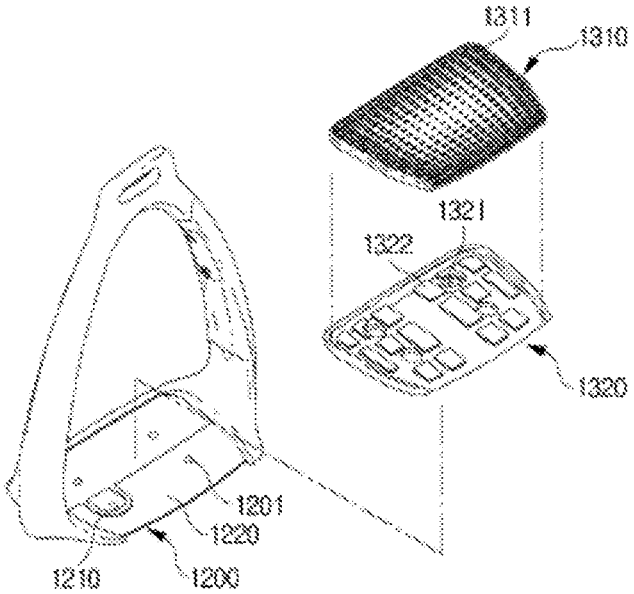
FIG. 5 is an exploded oblique view explaining the mode of combining the foot plate part in a stirrup having an opening and closing function according to the present invention.

FIG. 5 is an exploded oblique view explaining the mode of combining the foot plate part in a stirrup having an opening and closing function according to the present invention. The foot plate base plate (1200) of the main body part (1100) is wider than any other part, thus allowing a foot to be placed thereon and providing stabilizing support, and a structure for increasing the cushioning force and/or frictional force may further be disposed on the upper side thereof. Therefore, a preferred embodiment comprises a foot plate part (3000), which comprises: a foot plate upper plate (3100), a plurality of convex parts (1320) capable of generating frictional force being disposed on the upper side thereof; and a foot pad part (1320), disposed between the foot plate upper plate (1310) and the foot plate base plate (1200), for producing a cushioning effect.

On the upper side of the foot plate upper plate (1310), a plurality of convex parts (1320) capable of generating frictional force are formed, and said convex parts (1320) may be disposed optionally on the basis of frictional force and aesthetic appeal. Considering strength, the foot plate upper plate (1310) is made of the same material as the main body part (1100). The foot pad part (1320) may be tightly pressed against the lower side of the foot plate upper plate (1310) and the upper side of the foot plate base plate (1200) to produce a cushioning effect; for this purpose, the foot pad part (1320) may be made of a synthetic resin, rubber, or any other injection-molded substance. In this case, in order to accurately maintain the positional relationship with the foot plate upper plate (1310), one or more bulges (1322) may be formed on the upper side of the foot pad part (1320), insertable into a groove (not shown) formed on the lower side of the foot plate upper plate (1310).

Further, a plurality of foot plate coupling holes (1201) are formed penetrating the upper and lower sides of the pedal base plate (1200), thus allowing coupling with the pedal base plate (1200) and the pedal part (3000) by a combining component; a foot pad coupling hole (1321) may be formed in a position of the foot pad part (1320) that corresponds to said pedal coupling hole (1201). In a position of the bottom of the pedal upper plate (1310) that corresponds to the foot pad coupling hole (1321), a coupling groove (not shown) connectable to a coupling component is formed, and the portion where the coupling groove is disposed may be shaped protruding downwards to be insertable into the foot pad coupling hole (1321). Further, on the upper side of the pedal base plate (1200), a guiding part (1210) protruding upwards is formed, insertable into a guiding groove (not shown) formed on the bottom surface of the foot pad part (1320).

Figure 6:
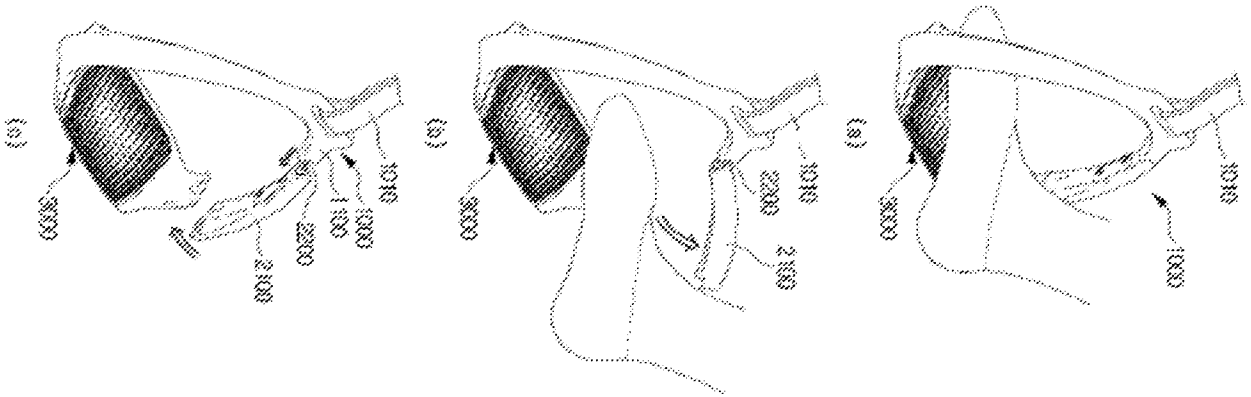
FIG. 6 is a schematic diagram for a use state of an operating mode of a stirrup having an opening and closing function according to the present invention.

FIG. 6 is a schematic diagram for a use state of an operating mode of a stirrup having an opening and closing function according to the present invention. In FIG. 6, (a) indicates a state in which a foot is properly placed to ride a horse; the main body part (1100), when in a state of forming a complete ring shape with the opening and closing part (2000), is connected to a saddle strap (1010) and bears the load. In order to allow the foot to be freed stably, the opening and closing part (2000) is preferably disposed facing the outer portion of the foot, namely, opposite the horse. In this case, the pedal part (3000) provides a cushioning effect and frictional force, and supports the foot.

In FIG. 6, (b) indicates a state in which the opening and closing part (2000) is open, allowing the foot to be freed in a situation such as falling from the horse. When a force is applied in a direction on the outside of the opening and closing part (2000) exceeding relevant combining force between the magnetic body (2010) and the removable part (1310), the coupling between them is released, and the lower end of the opening and closing part (2000) and the coupling part (1300) start separating. In this case, when a force is continuously applied to free the foot, the upper end of the opening and closing part (2000) gradually moves away from the extension part (1150), and the exposed portion of the wire part (2200) increases, that is, elongates; the opening and closing part (2000), by the wire part (2200) on the upper side, causes the open part (1160) to fully open in a state of being movable up and down, thereby freeing the foot from the side.

In FIG. 6, (c) indicates a state in which the foot is completely freed. Based on different situations, it is possible to consider the case in which the elasticity-providing part (2150) is omitted and the opening and closing part (2000) is kept open; however, in this case, the opening and closing part (2000) may be movable freely, possibly causing a secondary injury to the horse or the rider's body. Considering the above situation, when the foot is completely freed, the opening and closing part (2000) should be restored to a closed state or a state close thereto, thereby improving safety.

The upper end of the opening and closing part (2000) may remain connected by the wire part (2200); then, based on a restoring force applied by the elasticity-providing part (2150), the exposed portion of the wire part (2200) shrinks gradually, and the upper end of the opening and closing part (2000) is again tightly pressed against the end of the extension part (1150). In this case, as described above, the projecting part (2120) at the upper end of the opening and closing part (2000) is guided and inserted according to the indented part (1151) to be combined in a correct position. The lower end of the opening and closing part (2000) is a free end and is movable to a certain extent; by dead weight, the wire part (2200), and the restoring effect produced by the elasticity-providing part (2150), when its lower end is close to the coupling part (1300), the magnetic body (2010) and the removable part (1310) are combined by means of magnetic force. In this case, the contact part (2130) and the segment gap part (1320) provide the function of guiding correct coupling.

As described above, with a stirrup having an opening and closing function according to the present invention, in an abnormal condition, for example, in case of a fall from a horse, the opening and closing part is opened on the basis of a force applied from one side so that the foot is freed naturally, thus preventing an injury. In addition, when the foot is freed, a closed state is restored by means of restoring force and magnetic force to prevent any secondary damage or injury caused by the free movement of the opening and closing part, thereby significantly improving the safety of horse riding.

The present invention has been described in detail above with reference to the embodiments and drawings. However, the scope of the present invention is not limited to the above-described embodiments and drawings, and is defined only by the content of the following claims.

The invention claimed is:

1. A stirrup having an opening and closing function, which is coupled to a saddle so that a rider's foot rests thereon, the stirrup comprising:

a main body part;

a hook part configured to be fastened to a saddle strap;

a support part connected to a foot plate base plate, an upstanding wall projecting higher than the foot plate base plate on an opposite side thereof from the main body part, and an open part located between an upper edge of the upstanding wall of the support part and a lower edge of the main body part;

an opening and closing part, detachably connected to the open part;

a wire part, connected to an upper end of the opening and closing part and the main body part, the wire part being hidden inside the support part and the opening and closing part when in a closed condition, and opposite ends of the wire part being hidden inside the support part and the opening and closing part when in an open and foot releasing condition;

a spring coupled to one of the ends of the wire part; and a magnetic body disposed on a bottom end of the opening and closing part, allowing the bottom end to be attachable to the main body part by magnetic force;

when a rider's foot force is applied in an outward direction against the opening and closing part, which exceeds the magnetic force, the bottom end of the opening and closing part outwardly rotates away from the upstanding wall while the wire part allows the upper end of the opening and closing part to move relative to the lower edge.

2. The stirrup having an opening and closing function as claimed in claim 1, the main body part comprising:

an extension part, extending downwards from the upper side of the open part and connected to the wire part; and a coupling part, extending upwards from the lower side of the open part, on which a removable part is disposed that is combinable with the magnetic body by magnetic force.

3. The stirrup having an opening and closing function as claimed in claim 2, wherein one end of the wire part is combined with the extension part and the other end thereof is elastically supported by an elasticity-providing part in a flexible space formed in the opening and closing part; the elasticity-providing part, when the opening and closing part opens and the foot is completely freed, causes the wire part to shrink, so that the upper end of the opening and closing part is combined with the extension part and the lower end of the opening and closing part comes close to the coupling part, allowing the magnetic body to be detachably coupled to the removable part by magnetic force.

4. The stirrup having an opening and closing function as claimed in claim 3, wherein the upper end of the elasticity-providing part is supportable by an upper inner wall in the flexible space and the lower end thereof is supportable by a fixed part combined with the other end of the wire part.

5. The stirrup having an opening and closing function as claimed in claim 3, wherein on the opening and closing part, a projecting part that projects upwards may be formed and, when the elasticity-providing part causes the wire part to shrink, is guided to be smoothly inserted into an indented part formed on the extension part.

6. The stirrup having an opening and closing function as claimed in claim 2, wherein the coupling part may be configured with a segment gap part that is inwardly layered, corresponding to a contact part of the opening and closing part in which a magnetic body is disposed, and the spring has a helical shape internally located within the opening and closing part.

7. The stirrup having an opening and closing function as claimed in claim 1, wherein the stirrup further comprises a foot plate part, which comprises:

a foot pad part, combined with the upper of the foot plate base plate to provide a cushioning effect; and a foot plate upper plate, which is disposed on the upper side of the foot pad part and on which a convex part is further configured.

8. A horse riding stirrup comprising:

a main body;

a saddle strap connector coupled to an upper portion of the main body;

a foot support located at a lower portion of the main body opposite the saddle strap connector;

an opening and closing arm moveably extending between the upper portion of the main body and the foot support;

a flexible wire rotatably connecting an upper end of the arm to the main body;

a helical spring connected to one end of the wire to allow extension of the wire when a lower end of the arm is rotated away from the foot support, the helical spring being located within the arm such that the wire is extendable between the arm and the main body; and a magnet connecting the lower end of the arm to the foot support.

9. The stirrup of claim 8, wherein the wire is hidden within the main body and the arm when the arm is magnetically connected to the foot support.

10. The stirrup of claim 8, wherein the foot support includes an upwardly projecting wall with an opening between an upper edge thereof and a lower edge of a downwardly projecting support, the arm opening and closing the opening, and the magnet connects substantially vertically facing surfaces of the lower end of the arm to the upwardly projecting wall.

11. The stirrup of claim 1, wherein the spring is a helical spring located within the opening and closing part, such that the wire is extendable between the opening and closing part, and the main body.

12. The stirrup of claim 8, wherein the wire is elongated and extends internally within the arm.

13. The stirrup of claim 8, further comprising a cushioning foot pad located between a foot upper plate and a foot base plate, which are secured to the foot support, the foot pad having a coupling hole and being synthetic resin or rubber, and the foot base plate including an upwardly protruding guide.

14. A horse riding stirrup comprising:

a main body;

a saddle strap connector coupled to an upper portion of the main body;

a foot support located at a lower portion of the main body opposite the saddle strap connector, the foot support including an upstanding partial wall;

an opening and closing arm moveably extending between the upper portion of the main body and the upstanding partial wall of the foot support;

a flexible and elongated coupling rotatably connecting an upper end of the arm to the main body;

the coupling being hidden within the main body and the arm when the arm is closed against the upstanding partial wall of the foot support;

a magnet connecting the lower end of the arm to the upstanding partial wall of the foot support; and a cushioning foot pad located between a foot upper plate and a foot base plate, which are secured to the foot support, the foot pad having a coupling hole and being synthetic resin or rubber, and a protruding guide inserted into a guiding groove to couple the foot base plate to the foot pad.

15. The stirrup of claim 14, further comprising a spring located within the arm, such that the coupling, which is a wire, is extendable between the arm and the main body.

16. The stirrup of claim 14, wherein the coupling extends internally within the arm.

17. The stirrup of claim 14, further comprising a helical spring coupled to the coupling.

18. The stirrup of claim 14, wherein the magnet connects substantially vertically facing surfaces of the lower end of the arm to the upwardly projecting partial wall at a location higher than the foot support.

* * * * *